US005130013A

United States Patent [19]

Kageyama et al.

[11] Patent Number: 5,130,013

[45] Date of Patent: Jul. 14, 1992

[54] PROCESS FOR PRODUCING A LIQUEFIED COAL OIL AND A CATALYST FOR THE PROCESS

[75] Inventors: Yoichi Kageyama, Isehara; Iwao Yamamoto, Machida; Takahisa Yamaura, Kawasaki; Jun Imai, Sagamihara, all of Japan

[73] Assignees: Mitsubishi Kasei Corporation, Tokyo; Kabushiki Kaisha Kobe Seiko Sho, Hyogo; Idemitsu Kosan Company Limited; Cosmo Oil Co., Ltd., both of Tokyo, all of Japan

[21] Appl. No.: 595,757

[22] Filed: Oct. 9, 1990

Related U.S. Application Data

[63] Continuation-in-part of Ser. No. 372,137, Jun. 26, 1989, abandoned, which is a continuation of Ser. No. 606,198, May 2, 1984, abandoned.

[30] Foreign Application Priority Data

May 6, 1983 [JP] Japan ..... 58-79068
Oct. 7, 1983 [JP] Japan ..... 58-187908

[51] Int. Cl.[5] ..... C10G 1/06

[52] U.S. Cl. ..... 208/413; 208/419; 208/422; 208/423

[58] Field of Search ..... 208/412, 400, 413, 422, 208/423, 419

[56] References Cited

U.S. PATENT DOCUMENTS

| | | | |
|---|---|---|---|
| 1,922,499 | 8/1933 | Pier et al. | 208/10 |
| 3,725,246 | 4/1973 | Kmercak et al. | 208/10 |
| 3,920,536 | 11/1975 | Seitzer et al. | 208/10 |
| 3,930,984 | 6/1976 | Pitchford | 208/10 |
| 3,954,671 | 5/1976 | White | 208/111 X |
| 4,011,153 | 3/1977 | Fu | 208/10 |
| 4,021,329 | 5/1977 | Seitzer | 208/10 |
| 4,257,872 | 3/1981 | La Pierre et al. | 208/111 X |
| 4,353,791 | 10/1982 | Pellet | 208/10 |
| 4,354,920 | 10/1982 | Rosenthal et al. | 208/10 |

FOREIGN PATENT DOCUMENTS

| | | | |
|---|---|---|---|
| 7723101 | 3/1979 | Australia . | |
| 6422840 | 5/1981 | Australia . | |
| 2723018 | 3/1978 | Fed. Rep. of Germany | 208/10 |

*Primary Examiner*—Anthony McFarlane
*Attorney, Agent, or Firm*—Oblon, Spivak, McClelland, Maier & Neustadt

[57] ABSTRACT

A process for producing a liquefied coal oil by a two step hydrogenation reaction of coal, which comprises subjecting coal to a first hydrogenation and subjecting at least a part of the reaction product of the first hydrogenation to a second hydrogenation, wherein the second hydrogenation is conducted in the presence of an alkali metal compound and/or an alkaline earth metal compound and a catalyst carrying a metal of Group VI-A and a metal of Group VIII of the Periodic Table.

5 Claims, 1 Drawing Sheet

PROCESS FOR PRODUCING A LIQUEFIED COAL OIL AND A CATALYST FOR THE PROCESS

This application is a continuation-in-part of application Ser. No. 07/372,137 filed on Jun. 26, 1989, now abandoned which is a continuation of abandoned application Ser. No. 06/606,198 filed May 2, 1984, now abandoned.

BACKGROUND OF THE INVENTION

Field of the Invention

The present invention relates to a process for producing a liquefied coal oil by a two step hydrogenation reaction of coal, and a catalyst useful for the second hydrogenation reaction. More particularly, the present invention relates to the hydrogenation treatment of a liquefied product of coal by a catalyst composed of a carrier such as alumina or silica alumina, and a metal of Group VI-A and a metal of Group VIII of the Periodic Table supported thereon, wherein an alkali metal compound and/or an alkaline earth metal compound is incorporated to the catalyst.

It is well known that a catalyst wherein a metal of Group VI-A of the Periodic Table such as molybdenum and a metal of Group VIII such as cobalt or nickel are supported on a carrier such as alumina, is catalytically effective for the hydrogenation treatment of a reaction product obtained by the first hydrogenation reaction of a coal such as bituminous coal, sub-bituminous coal, brown coal or lignite by e.g. hydrogenolysis or solvert extraction.

However, such hydrogenation reaction products, particularly the high boiling point fractions having boiling points of at least 400° C., contain substantial amounts of highly condensed aromatic hydrocarbons or aromatic compounds containing hetero-atoms such as nitrogen or sulfur in their molecules, which cause deactivation of the catalyst. In the hydrogenation treatment of such first hydrogenation reaction products, there used to be difficulties such as deactivation of the catalyst due to the formation of coke on the catalyst or clogging of a catalytic bed due to coking which takes place in the catalytic bed in the case of a continuous hydrogenation treatment in a fixed-bed type reactor.

The present inventors have conducted extensive researches to develop a process and a catalyst which are highly effective for the hydrogenation treatment of the first hydrogenation reaction product in a two step hydrogenation reaction of coal and which do not bring about the formation of coke on the catalyst. As a result, it has been found that when an alkali metal compound or an alkaline earth metal compound is used in combination with the catalyst carrying a metal of Group VI-A and a metal of Group VIII of the Periodic Table, the catalyst exhibits a superior catalyst activity, whereby the coking is substantially suppressed and the deterioration of the catalytic activity in the continuous hydrogenation treatment reaction is prevented to a substantial extent. The present invention has been accomplished based on these discoveries.

SUMMARY OF THE INVENTION

It is an object of the present invention to provide a superior process for the production of a liquefied coal oil by the two step hydrogenation reaction of coal and to provide a catalyst for the second hydrogenation reaction, which is capable of providing a high catalytic activity for a long period of time, while suppressing the coking on the catalyst and preventing the deterioration of the catalytic activity.

Such an object can be attained by a catalyst for such a second hydrogenation reaction which carries a metal of Group VI-A and a metal of Group VIII of the Periodic Table and which contains an alkali metal compound and/or an alkaline earth metal compound.

The present invention also provides a process for producing a liquefied coal oil by a two step hydrogenation reaction of coal, which comprises subjecting coal to a first hydrogenation and subjecting at least a part of the reaction product of the first hydrogenation to a second hydrogenation, wherein the second hydrogenation is conducted in the presence of the above-mentioned catalyst.

BRIEF DESCRIPTION OF THE DRAWINGS

A more complete understanding of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
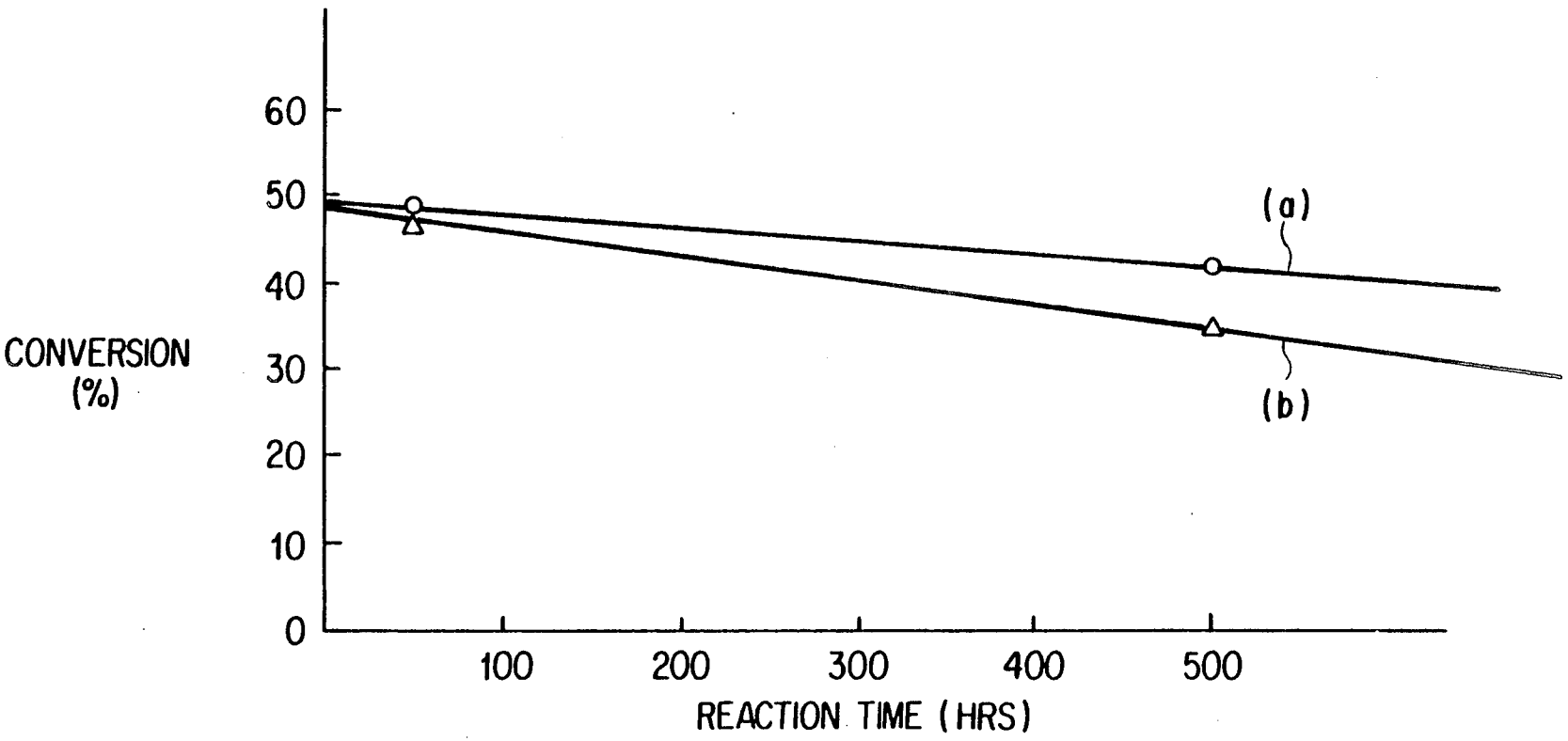
FIG. 1 is a graph which demonstrates the performance of the catalysts of Example 5 and Comparative Example 4 in terms of conversion versus reaction time.

Now, the present invention will described in detail with reference to the preferred embodiments.

The catalyst to be used in the present invention, may be the one wherein a Group VI-A metal and a Group VIII metal are supported on a carrier such as commercial alumina or silica-alumina or on a solid acid such as alumina prepared from boehmite. As the Group VI-A metal, there may be mentioned molybdenum or tungsten, and as the Group VIII metal, cobalt or nickel is particularly preferred. As the starting material containing such a metal, there may be mentioned cobalt nitrate, nickel nitrate, ammonium molybdate or ammonium tungstate. These compounds are supported on the carrier and preferably fired. With respect to the amounts of these metal components supported on the carrier, the amount of the Group VI-A metal is from 1 to 50% by weight, preferably from 5 to 20% by weight, in the catalyst. The amount of the Group VIII metal is from 0.1 to 20% by weight, preferably from 1 to 10% by weight, in the catalyst. Such a catalyst is usually sulfided by e.g. elemental sulfur, hydrogen sulfide or carbon disulfide, prior to its use. The amount of the sulfur component to be used, is preferably at a level of the stoichiometric amount reactive as sulfur with the total metal components.

As the alkali metal or alkaline earth metal compounds, there may be employed hydroxides such as sodium hydroxide, potassium hydroxide or calcium hydroxide; halides such as sodium chloride, potassium chloride, sodium iodide or calcium iodide; mineral acid salts such as carbonates, nitrates, nitrites or sulfates; organic acid salts such as acetates or oxalates; oxides; or alkali metal or alkaline earth metal compounds such as alcoholates.

The amount of the alkali metal compound and for the alkaline earth metal compound is from 0.001 to 5% by weight as the alkali metal element or the alkaline earth metal element in the catalyst.

The alkali metal compound or the alkaline earth metal compound may be present in any form in the reaction system. However, it is most preferred that a catalyst carrying the Group VI-A metal and the Group VIII metal is treated with the alkali metal or alkaline earth metal prior to sulfiding the catalyst. As the treating method, there may be employed a method wherein a catalyst is immersed in an aqueous solution or an alcohol solution in which an alkali metal compound or an alkaline earth metal compound is dissolved, and then dried. In this case, the catalyst may be fired again. However, the catalyst may be used without such firing. Otherwise, there may be employed a method wherein an alkali metal compound or an alkaline earth metal compound is incorporated during the production of the catalyst, or a method in which the alkali metal compound or the alkaline earth metal compound may be added to the reaction system.

The property of the catalyst, particularly the pore distribution, influences the hydrogenation of the first hydrogenation reaction product. Accordingly, it is particularly preferred to employ a catalyst which has a total pore volume of at least 0.6 cc/g as measured by a mercury compression method and a pore distribution such that the pore volume of pores having radii of at least 100 Å is from 20 to 70% of the total pore volume, and the pore volume of pores having radii of from 37.5 to 100 Å is from 30 to 80% of the total pore volume. With such a specified property, the catalytic activity on the heavy hydrocarbon compounds contained in the first hydrogenation reaction product increases, and the activity on the light components decreases, whereby it is possible to effectively avoid such a problem that the formed liquefied oil is further decomposed to gas and the yield of the liquefied oil decreases.

There is no particular restriction to the first hydrogenation reaction product to which the catalyst of the present invention is applied. However, it is preferred to use as the first hydrogenation reaction product, for instance, a liquefied product of coal obtained by the hydrogenolysis of a coal such as brown coal, bituminous coal or sub-bituminous coal together with a hydrocarbon solvent in the presence or absence of a catalyst under a hydrogen pressure of from 100 to 300 kg/cm$^2$G at a temperature of from 350° to 500° C. for 0.1 to 2 hours, followed by solvent extraction. The liquefied product of coal as the first hydrogenation reaction product, may be liquid or solid at room temperature. Particularly preferred is a solid solvent-refined coal.

The second hydrogenation reaction of the first hydrogenation reaction product may be conducted by a known method under known conditions in a batch system, a boiled-bed system or a fixed-bed system. For instance, it is possible to efficiently hydrogenate and decompose the first hydrogenation reaction product and obtain light fractions by conducting the second hydrogenation reaction under a hydrogen pressure of from 10 to 300 kg/cm$^2$G at a reaction temperature of from 250° to 500° C., at a liquid space velocity of the first hydrogenation reaction product of from 0 to 5 hr$^{-1}$ at a volume ratio of hydrogen to the first hydrogenation reaction product of from 500 to 2000.

Further, the two step hydrogenation reaction of coal according to the present invention, may be modified by adding a preliminarily treatment before or after, or inbetween the hydrogenation reactions, or by dividing each hydrogenation reaction into a plurality of stages.

For instance, in the case where the second hydrogenation reaction is applied to a solvent-refined coal, the second hydrogenation reaction may be further divided into a first stage and a second stage, and high boiling point fractions from the first stage are supplied to the second stage. In this case, the above-mentioned catalyst containing an alkali metal and/or alkaline earth metal, is used at least in the first stage wherein the first reaction product itself is hydrogenated. Whereas in the second stage, there will be no substantial problem of the formation of coke whether or not the catalyst used, contains an alkali metal or an alkaline earth metal. In the second stage, it is preferred to use a catalyst wherein the pore volume of pores having pore radii of at most 100 Å is large, as the catalyst suitable for hydrogenating a partially hydrogenated solvent-refined coal. Specifically, as such a catalyst, there may be mentioned a catalyst which has a total pore volume of at least 0.4 cc/g as measured by a mercury compression method and a pore distribution such that the pore volume of pores having radii of at least 100 Å is from 0 to 20% of the total pore volume and the pore volume of pores having radii of from 37.5 to 100 Å is from 80 to 100% of the total pore volume.

As described in the foregoing, by employing the process and the catalyst of the present invention for the hydrogenolysis of the first hydrogenation reaction product in the two step hydrogenation reaction cf coal, it is possible to minimize the precipitation of a carbonaceous substance on the catalyst, to prolong the effective life of the catalyst and to maintain a high catalytic activity for an extended period of time. Thus, the present invention is extremely valuable from the industrial point of view.

Now, the present invention will be described in further detail with reference to Examples. However, it should be understood that the present invention is by no means restricted by these specific Examples.

EXAMPLE 1

Into a solution prepared by dissolving 9.2 g of ammonium paramolybdate [$(NH_4)_6Mo_7O_{24}.H_2O$] and 4.8 g of nickel nitrate [$Ni(NO_3)_2.6H_2O$] in an aqueous ammonia solution and bringing the total volume to 40 ml, 20 g of an alumina carrier prepared from boehmite (surface area: 216 m$^2$/g, pore volume: 1.00 cc/g, pore volume of pores having radii of at least 100 Å: 0.66 cc/g, pore volume of pores having radii of from 37.5 to 100 Å: 0.34 cc/g, the same carrier being used also hereinafter) was immersed for 12 hours, and after the removal of the solution by filtration, dried at 120° C. for 12 hours, and then fired at 600° C. for 3 hours to obtain a catalyst. The Ni content was 2.4% by weight, and the Mo content was 12.7% by weight.

In a solution prepared by dissolving 0.02 g of sodium hydroxide in 100 ml of methanol, 5 g of this catalyst was immersed for 12 hours, and then vacuum-dried. The catalyst thus treated was fed into an autoclave having an internal capacity of 300 ml together with 80 g of a liquefied coal oil (boiling point: 300°-420° C./760 mmHg) and 0.05 g of sulfur, and the hydrogenation treatment was conducted under a hydrogen pressure of 100 kg/cm$^2$G at a reaction temperature of 450° C. for a reaction time of 60 minutes. Then, reaction mixture was filtered to remove the catalyst, and the filtrate was distilled. The conversion was calculated in accordance with the following formula I and shown in Table 1. Further, the catalyst recovered by the filtration, was thoroughly washed with tetrahydrofuran, dried and then subjected to an elemental analysis, whereby it was found that the amount of the deposited carbonaceous substance has as shown in Table 1.

$$\text{Conversion}(\%) = \left(1 - \frac{\text{Weight of recovered liquefied coal}}{\text{Weight of feed liquefied coal}}\right) \times 100 \quad \text{(I)}$$

EXAMPLE 2

The hydrogenation treatment was conducted in the same manner as in Example 1 except that the catalyst used, was prepared in such a manner that 5 g of the catalyst composed of nickel and molybdenum supported on the alumina carrier (Ni content: 2.4% by weight, Mo content: 2.7% by weight) was immersed in a solution prepared by dissolving 0.10 g sodium hydroxide in 100 ml of methanol, for 12 hours, and then vacuum dried. The results are shown in Table 1.

COMPARATIVE EXAMPLE 1

The hydrogenation treatment was conducted in the same manner as in Example 1 except that 5 g of the catalyst composed of nickel and molybdenum supported on the alumina carrier as used in Example 1 or 2, was used without any further treatment, together with 0.05 g of sulfur. The results are shown in Table 1.

TABLE 1

| | Conversion | Amount of carbon deposition on the catalyst* |
|---|---|---|
| Example 1 | 12.1% | 2.3% |
| Example 2 | 10.0% | 2.4% |
| Comparative Example 1 | 11.4% | 4.8% |

*% by weight based on the recovered catalyst

EXAMPLE 3

In a solution prepared by dissolving 0.2 g of sodium hydroxide in 100 ml of methanol, 10 g of a catalyst composed of nickel and molybdenum supported on the alumina carrier (Ni content: 3.4% by weight, Mo content: 8.0% by weight) was immersed in 12 hours and then vacuum-dried. The catalyst thus treated was fed into an autoclave having an internal capacity of 300 ml, together with 40 g of a solvent-refined coal (boiling points: at least 420° C./760 mmHg) and 0.72 g of sulfur. The hydrogenation treatment was conducted under a hydrogen pressure of 100 kg/cm$^2$G at a reaction temperature of 420° C. for a reaction time of 120 minutes, and then the reaction mixture was distilled. The conversion was calculated. The results are shown in Table 2. Further, the recovered catalyst was thoroughly washed with tetrahydrofuran, dried and subjected to an elemental analysis, whereby the carbonaceous substance precipitated on the catalyst was quantitatively analyzed. This result is also shown in Table 2.

COMPARATIVE EXAMPLE 2

The hydrogenation treatment was conducted in the same manner as in Example 3 except that 10 g of the catalyst composed of nickel and molybdenum supported on the alumina carrier (Ni content: 3.4% by weight, Mo content: 8.0% by weight) was used without any further treatment. The results are shown in Table 2.

TABLE 2

| | Conversion | Amount of carbon deposition on the catalyst* |
|---|---|---|
| Example 3 | 48% | 6.9% |
| Comparative Example 2 | 38% | 9.0% |

*% by weight based on the recovered catalyst

EXAMPLE 4

Into a solution prepared by dissolving 6.6 g of ammonium paramolybdate in an aqueous ammonia solution and bringing the total volume to 40 ml, 20 g of the same alumina carrier as used in Example 1, was immersed for 12 hours, and after the removal of the solution by filtration, dried at 120° C. for 12 hours and then fired at 600° C. for 3 hours. Further, in a solution prepared by dissolving 4.9 g of cobalt nitrate [$Co(NO_3)_2.6H_2O$] in water and bringing the total volume to 40 ml, the molybdenum-alumina carrier fired product was immersed for 12 hours, and then dried and fired under the safe conditions as in the treatment for supporting molybdenum on the carrier, whereby a cobalt-molybdenum-alumina catalyst was obtained. The Co content was 2.5% by weight and the Mo content was 9.0% by weight.

In a solution prepared by dissolving 0.2 g of sodium hydroxide in 100 ml of methanol, 10 g of this catalyst was immersed for 12 hours, and then vacuum-dried for 12 hours. Then, 10 g of the catalyst thus prepared, was fed into a 300 ml autoclave together with 0.72 g of sulfur, and the solvent-refined coal was subjected to hydrogenation treatment under the same conditions as in Example 3. The reaction mixture was distilled, and the conversion was obtained. The results are shown in Table 3.

COMPARATIVE EXAMPLE 3

The hydrogenation treatment was conducted in the same manner as in Example 4 except that 10 g of the catalyst composed of cobalt and molybdenum supported on the alumina carrier, as used in Example 4, was used without any further treatment.

TABLE 3

| | Conversion | Amount of carbon deposition on the catalyst* |
|---|---|---|
| Example 4 | 41% | 5.4% |
| Comparative Example 3 | 39% | 7.5% |

*% by weight based on the recovered catalyst

EXAMPLE 5

A catalyst composed of nickel and molybdenum supported on alumina (Ni content: 3.4% by weight, Mo content: 8.0% by weight) was immersed in a solution prepared by dissolving 0.02 part by weight of sodium hydroxide, relative to the catalyst, in methanol, for 12 hours, and then vacuum-dried. Then, this catalyst was packed in a fixed bed reaction apparatus.

A solvent-refined coal (boiling point: at least 420° C./760 mmHg) and a liquefied coal oil (boiling point: 250-420° C./760 mmHg) as a solvent, were mixed in a weight ratio of 1:2. The mixture was passed through the fixed bed reaction apparatus packed with the above-mentioned catalyst, at a reaction temperature of 400° C. under a hydrogen pressure of 100 kg/cm$^2$G and a liquid space velocity of 0.5 hr$^{-1}$.

This test was conducted continuously for 500 hours. The conversion was shown by the catalytic performance curve (a) in FIG. 1.

Further, the catalyst recovered after the continuous test, was thoroughly washed with tetrahydrofuran, then dried and subjected to an elemental analysis, whereby it was found that 13.1% by weight, based on the recovered catalyst, of carbonaceous substance was deposited on the catalyst.

COMPARATIVE EXAMPLE 4

The continuous hydrogenation treatment test was conducted in the same manner as in Example 5 except that the catalyst composed of nickel and molybdenum supported on alumina was used without the alkali metal or alkaline earth metal treatment.

The conversion was shown by the catalytic performance curve (b) in FIG. 1.

Further, it was found that 16.1% by weight, based on the recovered catalyst, of carbonaceous substance was deposited on the catalyst.

EXAMPLE 6

A catalyst was prepared in the same manner as described in Example 3, except that calcium acetate was employed in place of sodium hydroxide.

A hydrogenation treatment was also conducted in the same manner as described in Example 3. The results obtained are shown in Table 4 below.

EXAMPLE 7

A catalyst was prepared in the same manner as described in Example 4, except that calcium acetate was employed instead of sodium hydroxide.

A hydrogenation treatment was conducted in the same manner as described in Example 4. The results are shown in Table 4.

TABLE 4

| | Catalyst | Conversion | Amount of carbon deposition of the catalyst* |
|---|---|---|---|
| Example 6 | Ca—Ni—Mo (Ca 2%) | 46% | 6.1% |
| Example 7 | Ca—Co—Mo (Ca 2%) | 39% | 4.8% |

*% by weight based on the recovered catalyst.

We claim:

1. A process for producing a liquified coil oil by the two step hydrogenation of coal, comprising:

hydrogenating coal starting material in a first hydrogenation step; and then hydrogenating the hydrogenated coal obtained from the first step in a second hydrogenation step, said second hydrogenation step being conducted in the presence of a catalyst of a group VI-A metal and a group VIII metal of the Periodic Table supported on a carrier, said catalyst having a total pore volume of at least 0.6 cc/g as measured by the mercury compression method and a pore distribution such that the pore volume of pores having radii of at least 100 Å is from 20 to 70%, and the pore volume of pores having radii of from 37.5 to 100 Å is from 30 to 80%, and said catalyst having been treated by the positive addition thereto of a sodium compound, a calcium compound or a combination thereof, said addition of a sodium compound, a calcium compound or a combination thereof improving the life of the catalyst and reducing the amount of carbon deposited on the catalyst.

2. The process according to claim 1, wherein the sodium compound, the calcium compound, or combination thereof is present in the catalyst in an amount of from 0.001 to 5% by weight as sodium or calcium.

3. The process according to claim 1, wherein the metal of group VI-A of the Periodic Table is molybdenum, tungsten, or combination thereof and the metal of group VIII is nickel, cobalt, or combination thereof.

4. The process according to claim 1, wherein the reaction product of the first hydrogenation is a solvent-refined coal.

5. A process for producing a liquified coal oil by the two step hydrogenation of coal, comprising:

hydrogenating coal starting material in a first hydrogenation step; and then hydrogenating the hydrogenated coal obtained from the first step in a second hydrogenation step, said second hydrogenation step being conducted in the presence of a catalyst of a group VI-A metal and a group VIII metal of the Periodic Table supported on a carrier, said catalyst having a total pore volume of at least 0.6 cc/g as measured by the mercury compression method and a pore distribution such that the pore volume of pores having radii of at least 100 Å is from 20 to 70%, and the pore volume of pores having radii of from 37.5 to 100 Å is from 30 to 80%, said catalyst having been treated by the positive addition thereto of a sodium compound, a calcium compound or a combination thereof, and said catalyst containing said positively added metal in an amount of from 0.001 to 5% by weight of sodium or as calcium, and said positively added metal compound improving the life of the catalyst and reducing the amount of carbon deposited on the catalyst.

* * * * *

UNITED STATES PATENT AND TRADEMARK OFFICE

CERTIFICATE OF CORRECTION

PATENT NO. : 5,130,013

DATED : July 14, 1992

INVENTOR(S) : Yoichi Kageyama et al.

It is certified that error appears in the above-identified patent and that said Letters Patent is hereby corrected as shown below: On the title page: Item [73]

The fifth assignee has been omitted, should be, --Nippon Brown Coal Liquefaction Co., Ltd., Tokyo, Japan--.

Signed and Sealed this

Fourteenth Day of June, 1994

Bruce Lehman

*Attest:*

BRUCE LEHMAN

*Attesting Officer*

*Commissioner of Patents and Trademarks*